US011339803B2

(12) United States Patent
Baniameri et al.

(10) Patent No.: US 11,339,803 B2
(45) Date of Patent: May 24, 2022

(54) ROTARY MACHINE FOR MIXING, PUMPING OR AGITATING A FLUID AND A METHOD OF MOUNTING

(71) Applicant: Sulzer Management AG, Winterthur (CH)

(72) Inventors: Amir Baniameri, Gothenburg (SE); Erik Blechingberg, Gothenburg (SE); Mikael Andersson, Gothenburg (SE)

(73) Assignee: SULZER MANAGEMENT AG, Winterthur (CH)

( * ) Notice: Subject to any disclaimer, the term of this patent is extended or adjusted under 35 U.S.C. 154(b) by 646 days.

(21) Appl. No.: 15/468,617

(22) Filed: Mar. 24, 2017

(65) Prior Publication Data

US 2017/0292535 A1 Oct. 12, 2017

(30) Foreign Application Priority Data

Apr. 11, 2016 (EP) ..... 16164640

(51) Int. Cl.
*F04D 29/64* (2006.01)
*B01F 7/06* (2006.01)
(Continued)

(52) U.S. Cl.
CPC ..... *F04D 29/648* (2013.01); *B01F 27/09* (2022.01); *B01F 27/113* (2022.01); *B01F 27/71* (2022.01);
(Continued)

(58) Field of Classification Search
CPC ..... F04D 13/06; F04D 29/043; F04D 29/181; F04D 29/60; F04D 29/603; F04D 29/606;
(Continued)

(56) References Cited

U.S. PATENT DOCUMENTS 1,399,699 A * 12/1921 Donauer ..... B01F 7/06 366/330.3
2,096,597 A * 10/1937 Seabrooks ..... B01F 7/06 366/331

(Continued)

FOREIGN PATENT DOCUMENTS

DE 3417204 A1 6/1985
WO 03028870 A1 4/2003

OTHER PUBLICATIONS

Extended European Search Report dated Oct. 25, 2016 in corresponding EP Patent Application No. 16164640.

*Primary Examiner* — Dominick L Plakkoottam
*Assistant Examiner* — Charles W Nichols
(74) *Attorney, Agent, or Firm* — Global IP Counselors, LLP

(57) ABSTRACT

A rotary machine for mixing, pumping or agitating a fluid includes an impeller for acting on the fluid, a drive unit for rotating the impeller around a rotation axis, a drive shaft connecting the impeller with the drive unit, a mounting flange for fastening the rotary machine to a wall of a vessel, and a support structure for supporting the rotary machine, the support structure comprising at least one leg, each leg extending in a vertical plane from a first end along a longitudinal axis to a second end, each leg including an outer member and an inner member coaxially arranged in the outer member, and the inner member slidingly movable relative to the outer member for adjusting the length of the respective leg. In addition, a method of mounting a rotary machine for mixing, pumping or agitating a fluid to a wall of a vessel is proposed.

18 Claims, 5 Drawing Sheets

(51) Int. Cl.

| | |
|---|---|
| ***B01F 7/00*** | (2006.01) |
| ***B01F 15/00*** | (2006.01) |
| ***F04D 13/06*** | (2006.01) |
| ***F04D 29/043*** | (2006.01) |
| ***F04D 29/18*** | (2006.01) |
| ***B01F 27/09*** | (2022.01) |
| ***B01F 27/71*** | (2022.01) |
| ***B01F 27/113*** | (2022.01) |
| ***B01F 33/00*** | (2022.01) |
| ***B01F 35/31*** | (2022.01) |
| ***B01F 35/41*** | (2022.01) |

(52) U.S. Cl.
CPC ..... *B01F 33/86* (2022.01); *B01F 35/31* (2022.01); *B01F 35/4112* (2022.01); *B01F 35/4113* (2022.01); *F04D 13/06* (2013.01); *F04D 29/043* (2013.01); *F04D 29/181* (2013.01)

(58) Field of Classification Search
CPC ..... F04D 29/642; F04D 29/648; B01F 7/002; B01F 7/0208; B01F 7/00225; B01F 7/00341; B01F 7/06; B01F 15/00006; B01F 15/0048; B01F 15/00668; B01F 15/00675; B01F 15/00688; B01F 15/00694; B01F 15/0072; B01F 33/86; B01F 35/31; B01F 35/4112; B01F 35/4113; B01F 27/09; B01F 27/71; B01F 27/113
See application file for complete search history.

(56) References Cited

U.S. PATENT DOCUMENTS

| | | | | | |
|---|---|---|---|---|---|
| 2,194,027 | A * | 3/1940 | McDonald | B25H 1/06 | 182/129 |
| 4,640,386 | A * | 2/1987 | Hall | B25H 1/06 | 182/155 |
| 4,776,545 | A * | 10/1988 | Miyamoto | B25H 1/06 | 182/153 |
| 5,118,199 | A * | 6/1992 | Howk | B01F 7/063 | 366/292 |
| 5,954,156 | A * | 9/1999 | Cooke | B25H 1/06 | 182/153 |
| 2011/0284704 | A1* | 11/2011 | Pryor | A47B 9/14 | 248/188.5 |

* cited by examiner

ROTARY MACHINE FOR MIXING, PUMPING OR AGITATING A FLUID AND A METHOD OF MOUNTING

CROSS-REFERENCE TO RELATED APPLICATION

This application claims priority to European Application No. 16164640.1, filed Apr. 11, 2016, the contents of which are hereby incorporated herein by reference.

BACKGROUND

Field of the Invention

The invention relates to a rotary machine for mixing, pumping or agitating a fluid and to a method of mounting a rotary machine.

Background of the Invention

Rotary machines for mixing, pumping or agitating one fluid or several fluids, like for example agitators, are used in many different industrial processes for mixing or agitating a process fluid, e.g. a liquid or a liquid containing solids.

In most applications the process fluid is contained in a tank or a tower or another vessel and the agitator is mounted to a wall or the bottom or the cover of the vessel. Amongst the wide range of industries where agitators are used is, for example, the pulp and paper industry. Here, agitators are used, for example, for dilution, mixing or bleaching processes.

Basically a rotary machine like an agitator comprises an impeller or propeller for acting on the fluid, a shaft which is connected at one end to the impeller and at the other end to a drive unit for rotating the shaft with the impeller. The drive unit usually has a motor and a coupling for connecting the motor with the shaft, wherein the coupling comprises a belt drive or a gear box or any other suited transmission device.

SUMMARY

Typically the drive unit is arranged outside of the vessel and the shaft with the impeller located inside the vessel for agitating the process fluid. Both top-mounted and side-mounted agitators are known. Top-mounted agitators are usually mounted to the cover or the top part of the tower or the vessel with the shaft of the agitator extending vertically. Side-mounted agitators are usually mounted to a side wall of the tower or the vessel with the shaft extending horizontally. Examples for both types of agitators are those which are sold by the applicant under the brands SALOMIX™ and SCABA™.

Especially for side-mounted rotary machines like side-mounted pumps or side-mounted agitators there is often the need to provide additional support to the machine. Usually such machines comprise a mounting flange for fastening the rotary machine to the wall of a vessel. Since these parts which are outside the vessel, e.g. the drive unit and the coupling with the transmission device, have a considerable weight putting a very high load on the mounting flange it is known to provide a support structure that is connected to a housing part of the rotary machine located outside the vessel and extends therefrom to the ground or a suited foundation to support the rotary machine.

When the rotary machine is delivered to the location where it shall be installed the distance between the mounted rotary machine and the floor or the foundation is in most cases not yet known or not yet exactly known. Therefore, after the fastening of the rotary machine to the wall of the vessel by means of the mounting flange said distance has to be determined in an exact manner. After that, the legs of the support structure extending from the rotary machine to the floor have to be cut to the right length and the mounting plate of the support structure that abuts the rotary machine and/or the base of the support structure that abuts the floor is/are then welded to the respective support leg. This is quite a laborious and time-consuming process.

Starting from this state of the art it is therefore an object of the invention to propose a rotary machine for mixing, pumping or agitating a fluid that can be installed and supported in a simpler and less time-consuming manner. In addition it is an object of the invention to propose a method of mounting such a rotary machine to a wall of a vessel which is easier and less time-consuming than the methods known from the state of the art.

The subject matters of the invention satisfying these objects are characterized by the features described herein.

Thus, according to the invention a rotary machine for mixing, pumping or agitating a fluid is proposed comprising an impeller for acting on the fluid, a drive unit for rotating the impeller around a rotation axis, a drive shaft connecting the impeller with the drive unit, a mounting flange for fastening the rotary machine to a wall of a vessel, and a support structure for supporting the rotary machine, wherein the support structure comprises at least one leg, each leg extending in a vertical plane from a first end along a longitudinal axis to a second end, wherein each leg comprises an outer member and an inner member coaxially arranged in the outer member, and wherein the inner member is slidingly movable relative to the outer member for adjusting the length of the respective leg.

By providing the rotary machine with a support structure having at least one leg with an adjustable length the mounting of the rotary machine to the wall of the vessel becomes much easier and considerably less time-consuming. Due to the telescopic design of the leg or the legs the length of each leg may be adjusted very easily to the respective environment or to the given spatial circumstances. After the rotary machine has been mounted to the wall of the vessel by the mounting flange the inner member of each leg is moved with respect to the respective outer member until the second end of the leg contacts the floor or a foundation. After that the outer member is fixed relative to the inner member thus providing a firm support for the rotary machine. There is no need for additional cutting, welding or similar processes. It is an additional advantage that the same support structure may be used if the rotary machine is moved to a different location or changes in the distance from the rotary machine to the foundation require an adaption of the support structure. With the rotary machine according to the invention the leg or the legs of the support structure is/are easily adjustable to any new location or to changes in the distance between the rotary machine and the foundation.

According to a preferred embodiment, each leg comprises a mounting plate at the first end of the respective leg for mounting the leg to a housing part of the rotary machine, and a base plate at the second end of the respective leg for connecting the leg to a foundation or the ground. The mounting plate renders an easy detachment and an easy fixing of the respective leg to the housing part of the rotary machine possible. By the base plate, the respective leg may be firmly connected, for example by screws, to the foundation or to the floor.

It is an advantageous measure when each outer member comprises at least one pre-drilled hole for receiving a securing element. As soon as the leg is adjusted to the correct length the pre-drilled hole in the outer member may be used to drill a perforation through the entire leg in a horizontal direction. After that a securing element, e.g. a screw, is inserted into the perforation from one side of the leg until its end exits the opposing wall of the leg where a nut is screwed on this end, thus safely fixing the inner member with respect to the outer member.

In one preferred embodiment, a plane in which the mounting plate extends and the longitudinal axis of the leg include a mounting angle that is different from 90 degree for each leg. This provides an especially stable support.

In another preferred embodiment the support structure comprises only a single leg. In such an embodiment the plane in which the mounting plate extends and the longitudinal axis of the leg include a mounting angle that is 90 degree. This provides an especially stable support.

From a practical point of view it is preferred that each outer member and each inner member has a rectangular cross section, preferably a square cross section, in a section perpendicular to the longitudinal axis of the respective leg.

Having a rectangular cross section the outer member of each leg has four side faces. It is preferred that two different and abutting side faces each include at least one pre-drilled hole. This measure results in high flexibility regarding a very simple and easy fixation of the inner member with respect to the outer member.

According to a preferred embodiment the rotary machine has two legs, wherein the mounting angle for each leg is between 60° and 85°, preferably between 70° and 80°.

According to a further advantageous measure the rotary machine has a connecting part being fixed to the housing part of the rotary machine and designed for being connected to each leg in a detachable manner. The connecting member may be designed in such a manner that it matches the outer shape of the housing part thus providing an optimal support.

Preferably each mounting plate is mountable to the connecting part by screws. This enables an easy fixing and detaching of the respective leg.

According to a preferred application the rotary machine is designed as an agitator for mixing or agitating a fluid.

Preferably the agitator is designed for being horizontally mounted to the wall of the vessel. But it is also possible that the agitator is designed for oblique mounting to the wall of the vessel, i.e. the rotation axis of the mounted agitator includes an angle with the horizontal direction that is different from zero degree.

In addition, according to another aspect of the invention a method of mounting a rotary machine for mixing, pumping or agitating a fluid to a wall of a vessel is proposed, comprising the steps of fastening a mounting flange of the rotary machine to the wall of the vessel, and mounting at least one leg of a support structure to a housing part of the rotary machine, extending each leg by moving an inner member of the leg relative to a coaxially arranged outer member of the leg along a longitudinal axis of the leg until a base plate of the leg contacts a foundation, and fixing the inner member to the outer member of the respective leg.

This method enables a much easier and considerably less time-consuming mounting of the rotary machine to the wall of a vessel.

According to a preferred embodiment the step of fixing the inner member to the outer member of the respective leg comprises: selecting one of a plurality of pre-drilled holes in the outer member, using the selected hole for generating a perforation extending through the entire leg, preferably in a horizontal direction or in a direction perpendicular to the longitudinal axis, inserting a securing element into the perforation for fixing the inner member to the outer member.

From a practical point of view and in order to provide a very good support it is preferred, when exactly two legs are used for supporting the rotary machine.

The method according to the invention is in particular suited when the rotary machine is an agitator, in particular an agitator for being horizontally mounted.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

In the following description of preferred embodiments reference is made to an agitator as an example for a rotary machine according to the invention. Although this is in practice an important embodiment of the invention it has to be understood that the invention is not restricted to such embodiments as an agitator. The rotary machine according to the invention may also be designed as any other type of a rotary machine for mixing, pumping or agitating fluids, wherein the rotary machine is intended for being mounted to a wall of a vessel. In particular, the rotary machine may also be a pump.

Figure 1:
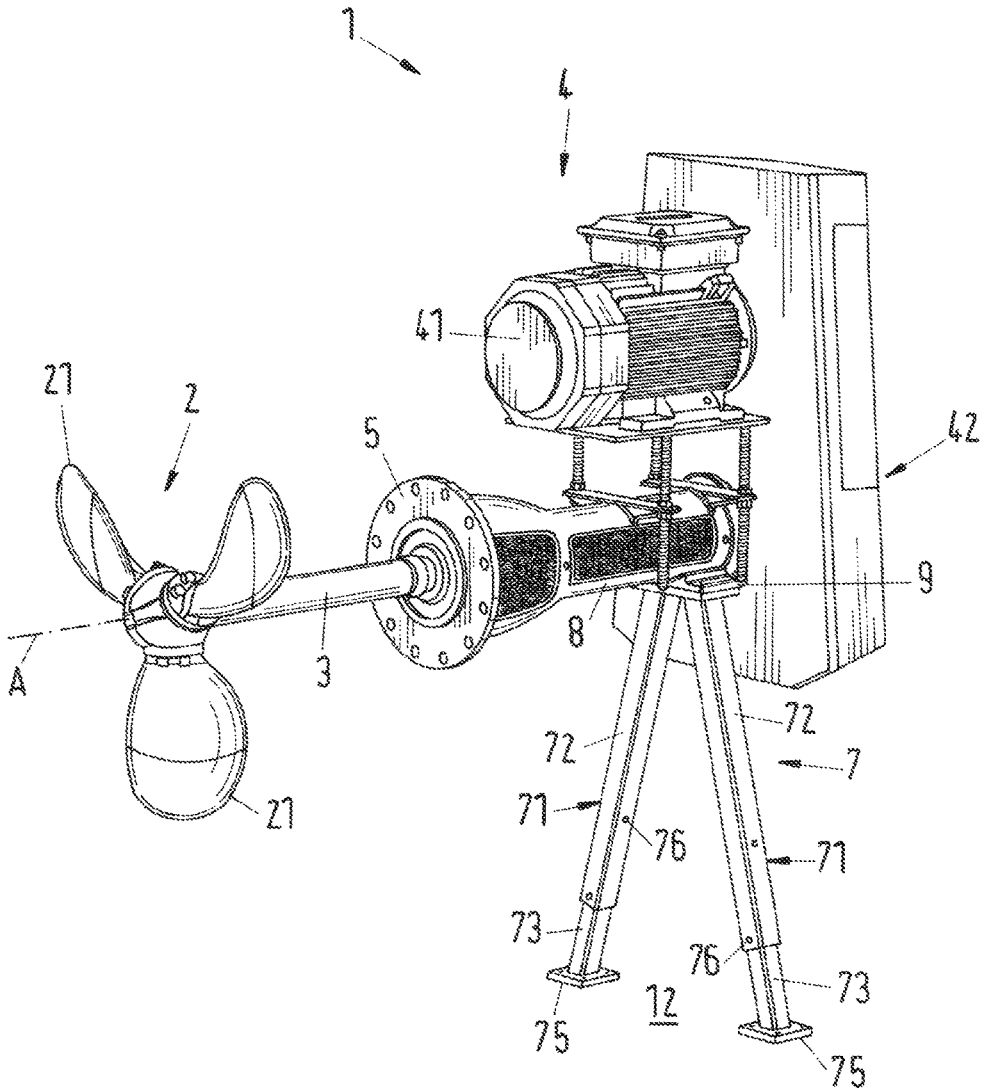
FIG. 1 is a perspective view of a first embodiment of a rotary machine according to the invention and designed as an agitator.

FIG. 1 shows a perspective view of a first embodiment of a rotary machine according to the invention. This first embodiment is designed as an agitator which is designated in its entity with reference numeral 1. For the sake of a better understanding, firstly the general setup of an agitator will be explained referring to FIG. 1. The agitator 1 comprises an impeller 2 having a hub and three blades 21 mounted to the hub for acting on a fluid.

The hub of the impeller 2 is connected to an end of a drive shaft 3. The other end of the drive shaft 3 is operatively connected to a drive unit 4 for rotating the drive shaft 3 and the impeller 2 connected therewith around a rotation axis A. The drive unit 4 comprises a motor 41, for example an electric motor 41, and a coupling 42 for operatively connecting the motor 41 with the drive shaft 3.

The coupling 42 shown in FIG. 1 has a belt drive for connecting the motor 41 to the drive shaft 3. It goes without saying that the invention is not restricted to such a belt drive. The drive unit 4 of the agitator 1 may also be designed with any other coupling 42 between the motor 41 and the drive shaft 3 known in the art, for example with a gear box or any other suited transmission device. In addition, the relative arrangement of the motor 41, the coupling 42 and the drive shaft 3 shown in FIG. 1 shall be understood exemplary. There are many other arrangements known in the art that are also suited for the agitator 1.

The agitator 1 shown in FIG. 1 is designed as a side-mounted agitator 1 and designed for being mounted in particular horizontally to a wall of a vessel, a tank, a tower, a container or any other receptacle, i.e. the drive shaft 3 is extending horizontally in the usual orientation of use of the agitator 1. Although this is a preferred embodiment for the agitator 1, the invention is not restricted to side-mounted or horizontal agitators. The agitator 1 may also be designed for example as a top-mounted or vertical agitator, i.e. with the drive shaft extending vertically in the usual orientation of use. Furthermore, it is also possible that the agitator 1 is designed for an oblique mounting to the wall of a vessel, i.e. the rotation axis A or the drive shaft 3, respectively, of the mounted agitator includes an angle with the horizontal direction that is different from zero degree and different from 90 degree.

Figure 5:
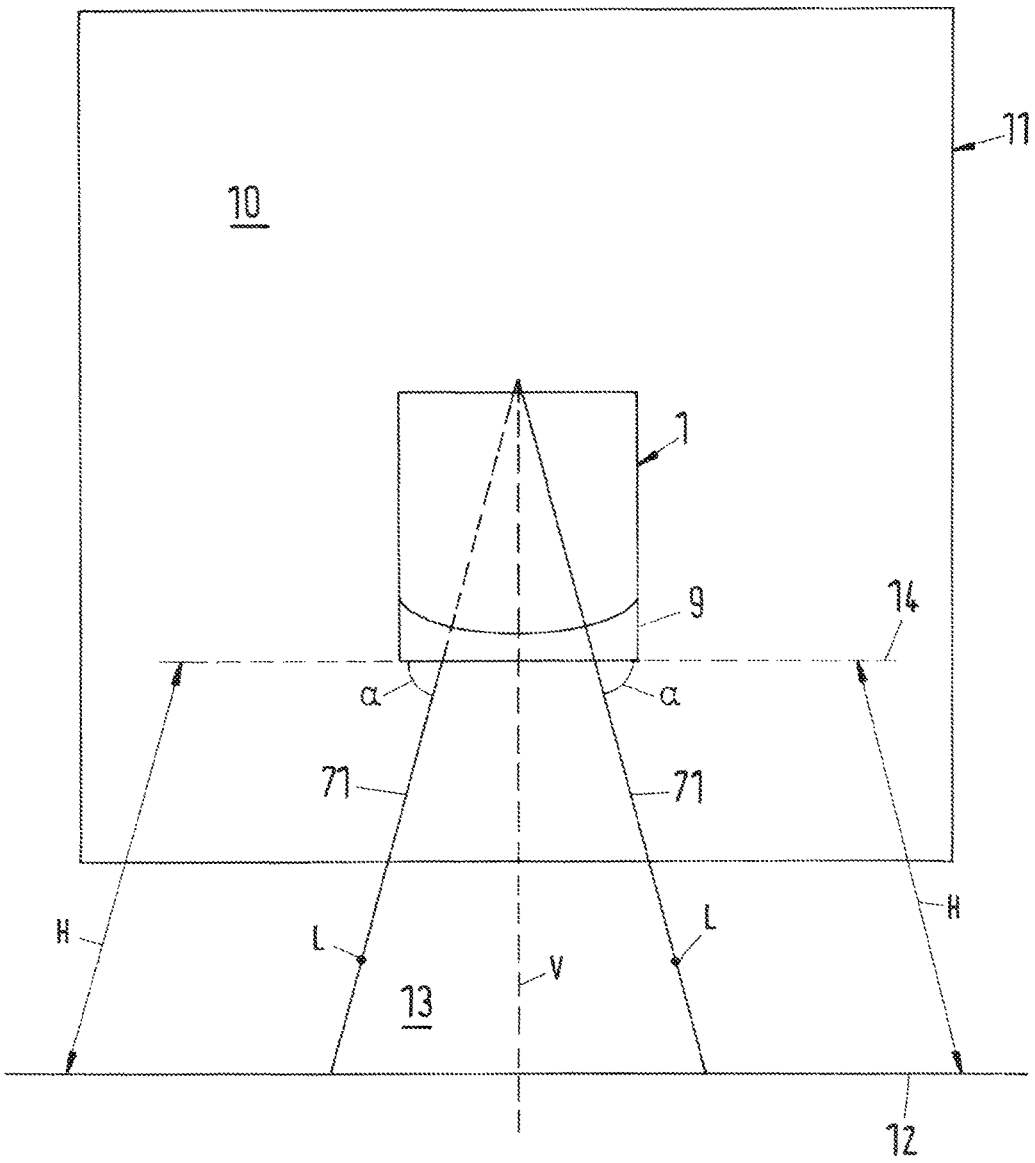
FIG. 5 is a schematic sketch showing a plan view from the backside.

For a better understanding FIG. 5 shows a schematic sketch corresponding to a plan view from the backside of the agitator 1, wherein the backside is the side facing away from the impeller 2. In the representation of FIG. 5 the agitator 1 is fastened to a wall 10 of a vessel 11, wherein the vessel 11 may be any type of a receptacle, e.g. a tower or a tank.

The side-mounted agitator 1 has a mounting flange 5 (see FIG. 1) for fastening the agitator 1 to the wall 10 of the vessel 11. The mounting flange 5 surrounds the drive shaft 3 concentrically and comprises several bores for receiving screws or bolts for fastening the agitator 1 to the wall 10 in a manner which is as such known in the art. When the agitator 1 is mounted to the wall 10, the mounting flange 5, the impeller 2 and the part of the shaft drive 3 between the mounting flange 5 and the impeller 2 are located within the vessel 11, containing the process fluid to be agitated or mixed or pumped by the impeller 2. Further details of the agitator 1 such as seals and bearings are well known to the skilled person and therefore will not be described in more detail.

In order to support the agitator 1 and to unload the mounting flange 5 from the weight especially of the drive unit 4 the agitator 1 comprises a support structure 7 extending between a housing part 8 of the agitator 1 and a foundation 12 or the floor 12. The foundation 12 may be the floor or the ground of the location where the agitator 1 is installed or a solid stand or baseplate which is able to bear the weight of the agitator 1 transferred to it by the support structure 7.

In the first embodiment the support structure 7 comprises a plurality of legs 71—in this embodiment exactly two legs 71—each leg extending in a vertical plane 13 (FIG. 5). A vertical plane 13 shall be understood as a plane that is perpendicular to the earth's surface, i.e. a plane extending in the direction of gravity. A horizontal plane shall be understood as a plane that is parallel to the earth's surface, i.e. a plane extending perpendicular to the direction of gravity. In the same manner, 'vertical' denotes a direction that is parallel or equal to the direction of gravity and 'horizontal' denotes a direction that is perpendicular to the direction of gravity.

Figure 2:
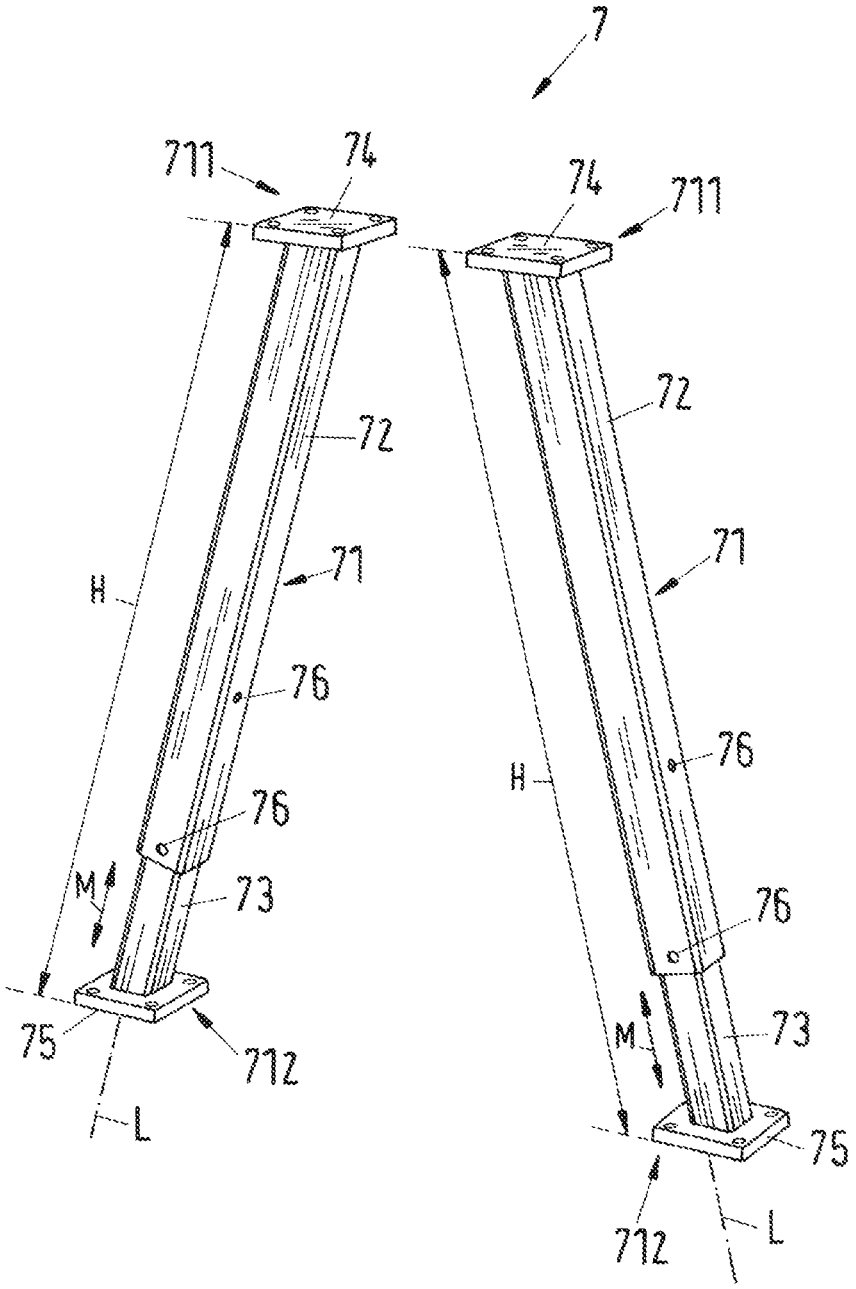
FIG. 2 is a perspective view of the legs of the support structure.

For a better understanding, FIG. 2 shows a perspective view of the two legs 71 of the support structure 7. Each leg 71 extends in the vertical plane 13 (FIG. 5) from a first end 711 along a longitudinal axis L to a second end 712 and comprises an outer member 72 as well as an inner member 73 coaxially arranged in the outer member 72, wherein the inner member 73 is slidingly movable relative to the outer member 72 in direction of the longitudinal axis L for adjusting the length H of the respective leg 71 to the distance between the housing part 8 of the agitator 1 and the foundation 12. The movability of the inner member 73 relative to the outer member 72 is symbolically indicated by the double arrows M in FIG. 2.

The inner member 73 and the outer member 72 are movable relative to each other telescopically to modify the total length H of the respective leg 71. In the embodiment shown in FIG. 1 and FIG. 2 each of the inner members 73 and each of the outer members 72 have a square cross section in a section perpendicular to the longitudinal axis L of the respective leg 71. Preferably the inner members 73 and the outer members 72 are all designed as hollow rod shaped members and manufactured from a metallic material, for example any kind of steel like a carbon steel or a stainless steel. The square cross sectional area of the respective inner member 73 is smaller than the square cross section of the corresponding outer member 72, in which the respective inner member 73 moves, to such an amount that the inner member 73 can easily slide with respect to the outer member 73.

Although the quadratic cross section of the inner members 73 and the outer members 72 is a preferred measure from the point of view of stability and procurement, it goes without saying that other cross sections perpendicular to the longitudinal axis L are also possible, for example a rectangular cross section, a circular cross section, a triangular cross section or the like.

As can be seen for example in FIG. 2, each leg 71 comprises a mounting plate 74 at the first end 711 and a base plate 75 at the second end 712 of the respective leg 71. Preferably, each mounting plate 74 and each base plate 75 is designed as a rectangular, particularly a quadratic, plate.

In the mounted state the base plate 75 extends in a horizontal plane, i.e. parallel to the foundation 12 and preferably comprises a plurality of holes—here four holes, one in each corner—for fixing the leg 71 to the foundation 12. After the length H of the respective leg 71 has been adjusted correctly the base plate 75 may be secured to the foundation 12 by means screws or bolts extending through the holes in the base plate 74.

In the mounted state each mounting plate 74 extends in a plane which is parallel to the rotation axis A of the agitator 1. If the agitator 1 is horizontally mounted, each mounting plate 74 extends in a horizontal plane 14 (FIG. 5).

Figure 3:
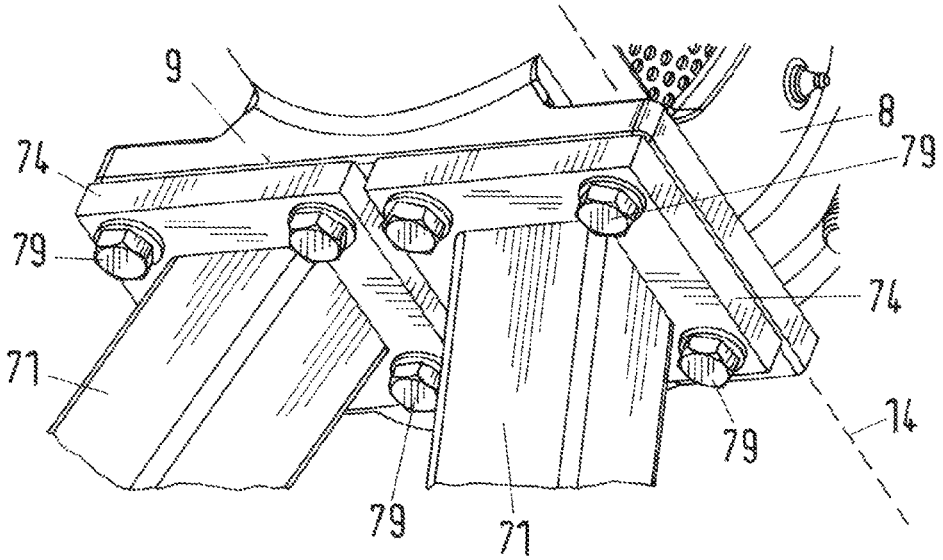
FIG. 3 is an enlarged perspective view from the underside on the connecting part of the embodiment shown in FIG. 1.
Figure 4:
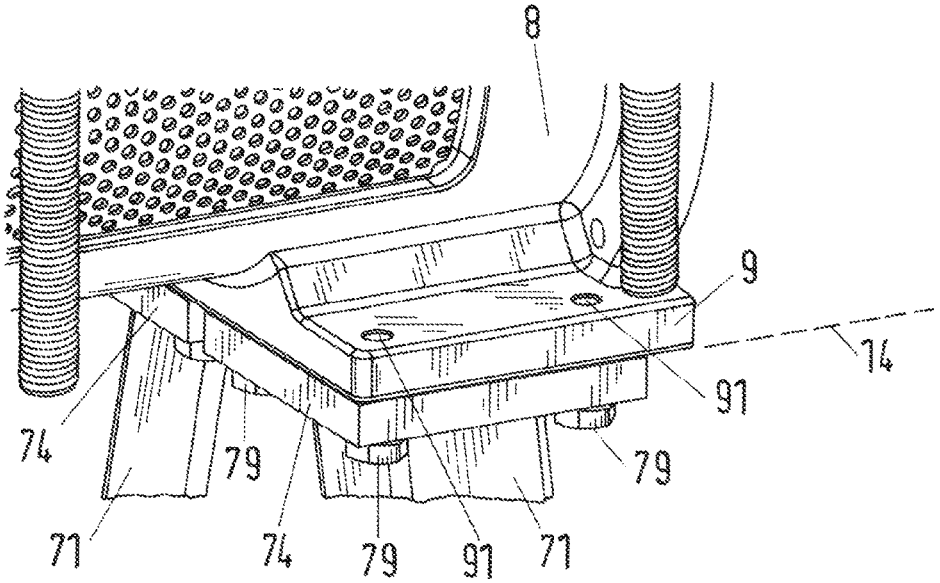
FIG. 4 is an enlarged perspective view from the upside on the connecting part of the embodiment shown in FIG. 1.

The mounting plate 74 is intended to firmly connect the leg 71 to the housing part 8 of the agitator 1. Referring in particular to FIG. 3 and FIG. 4, a preferred connection of the legs 71 with the housing part 8 is now described in more detail. FIG. 3 shows an enlarged perspective view from the underside on the connection between the legs 71 and the housing part 8 of the embodiment shown in FIG. 1, and FIG. 4 shows an enlarged perspective view from the upside on the connection.

The agitator 1 comprises a connecting part 9 that is fixed to the housing part 8 of the agitator 1. The surface of the connecting part 9 abutting the housing part 8 has a contour that matches the outer contour of the housing part 8, i.e. the shape of the surface of the connecting part 9 that contacts the housing part 8 is adapted to the outer surface of the housing part 8 to realize a large surface contact between the housing part 8 and the connecting part 9. This measure ensures a stable support and a uniform distribution of the load. In the embodiment shown in FIG. 3 and FIG. 4 the surface of the connecting part 9 being in contact with the housing part 8 is a curved surface wherein the curvature follows the curvature of the housing part 8.

The connecting part 9 may be formed integrally with the housing part 8 or it may be a separate part that is firmly connected to the housing part 8 by any appropriate means (device) or in any appropriate manner, for example by welding.

The surface of the connecting part 9 facing away from the housing part 8 is designed as a plane surface extending in the horizontal plane 14. The connecting part 9 is designed to be connected to the legs 71 in a detachable manner. In the described embodiment of the agitator 1 the plan surface of the connecting part 9 facing away from the housing part 8 includes a plurality of threaded holes 91 (FIG. 4) for receiving screws 79 which fix the legs 71 to the connecting part 9 in a detachable manner.

The mounting plate 74 of each leg 71 being designed as a quadratic plate includes a plurality of holes—here four holes, one in each corner of the mounting plate 74. According to this the connecting part has eight threaded holes 91 for receiving the screws 79 that fix the legs 71 with respect to the connecting member 9.

For mounting the legs 71 to the connecting member 9 the respective mounting plate 74 of the leg 71 is put to the connecting member 9, the screws 79 are inserted into the holes in the mounting plate 74 and screwed into the threaded holes 91 of the connecting member 9 thus firmly connecting the respective leg 71 with the connecting member 9.

As an alternative it is also possible to design the holes 91 that receive the screws 79 as plane bores or holes, i.e. without a thread. The screws 79 are then extending completely through said holes and secured respectively with a nut that is screwed to the end of the screw protruding from the upper surface of the connecting member 9.

After the leg 71 has been adjusted to the appropriate length H by telescopically moving the inner member 73 with respect to the outer member 72 the inner member 73 has to be fixed with respect to the outer member 72 to prevent any further relative movement between the inner member 73 and the outer member 72. To facilitate the fixation of the outer member 72 with respect to the inner member 73, it is advantageous when the outer member 72 comprises at least one pre-drilled hole 76 (FIG. 2), preferably extending perpendicular to the longitudinal axis L of the leg 71. In FIG. 2 each pre-drilled hole 76 extends through both opposing side faces of the respective outer member 72. The pre-drilled hole 76 is intended for receiving a securing element (not shown), for example a screw and a nut. For fixing the inner member 73 with respect to the outer member 72 the pre-drilled hole 76 is used as a guide for drilling a perforation extending through the entire leg 71, i.e. through both the outer member 72 and the inner member 73. The perforation can extend in a horizontal direction or in a direction perpendicular to the longitudinal axis L. After the perforation has been generated, the securing element, for example the screw, is inserted into the perforation and a nut is screwed to the end of the screw that extends through the perforation thereby firmly fixing the inner member 73 with respect to the outer member 72.

Preferably the outer member 72 has a plurality of pre-drilled holes 76. This provides the advantage that depending on the adjusted length H of the leg 71, i.e. how much the inner member 73 has been moved out of the outer member 72 an appropriate location may be chosen for providing the perforation for the securing element. In addition, a plurality of pre-drilled holes 76 enables the use of more than one, preferably two, securing elements, e.g. two screws and two nuts, for making the fixation of the outer member 72 relative to the inner member 73 even more stable, safe and reliable.

When the leg 71 has a rectangular or a square cross section perpendicular to its longitudinal axis L, as described hereinbefore, the outer member 72 has four side faces each extending in the direction of the longitudinal axis L. As can be seen in FIG. 1 and FIG. 2, for this design it is preferred that at least two different and abutting side faces of the outer member 72 are provided with at least one pre-drilled hole 76. Thereby it is possible to use two securing means, e.g. screws and nuts that extend perpendicular with respect to each other. This provides a very stable and reliable fixation of the inner member 73 with respect to the outer member 72. In addition, depending on the location where the agitator 1 is mounted, it might be difficult to access all side faces of the outer member 72 easily. In such cases one can choose the pre-drilled hole or holes 76 on that side face that is accessible the easiest.

In view of an optimal and stable support for the first embodiment of the agitator 1 it is preferred when the horizontal plane 14 (FIG. 5) in which the mounting plate 74 extends and the longitudinal axis L of the leg 71 include a mounting angle $\alpha$ that is different from 90 degree. In the described embodiment with exactly two legs 71 the mounting angle $\alpha$ has the same value for each leg 71. The preferred range for the mounting angle $\alpha$ is from 60° to 85°. Even more preferred the mounting angle $\alpha$ is between 70° and 80°. Preferably and as it is show in FIG. 5 the two legs 71 are arranged symmetrically with respect to the vertical direction V, i.e. each leg 71 includes the same angle with the vertical direction V. For the preferred range of the mounting angle $\alpha$ the resulting angle between the two legs 71 is between 30° and 60°. For the more preferred range of the mounting angle $\alpha$ between 70° and 80° the resulting angle between the two legs 71 is between 20° and 40°.

A preferred method for mounting the agitator 1 to the wall 10 of the vessel 11 comprises the following steps: the mounting flange 5 of the agitator 1 is fastened to the wall 10 of the vessel 11. If not yet done the leg 71 or the legs 71 is/are connected and fixed to the connecting part 9. The inner member 73 is slidingly moved with respect to the outer member 72. This movement can be caused by gravity only, i.e. the inner member 73 is released with respect to the outer member 72 and drops down to the foundation 12. Thus, each leg 71 is adjusted or extended to the correct length H by moving the inner member 73 of the leg 71 relative to the coaxially arranged outer member 72 of the leg 71 along the longitudinal axis L of the leg 71 until the base plate 75 of the leg 71 contacts the foundation 12. After that the inner member 73 is fixed to the outer member 72 of the respective leg 71, for example in a manner as described hereinbefore.

Figure 6:
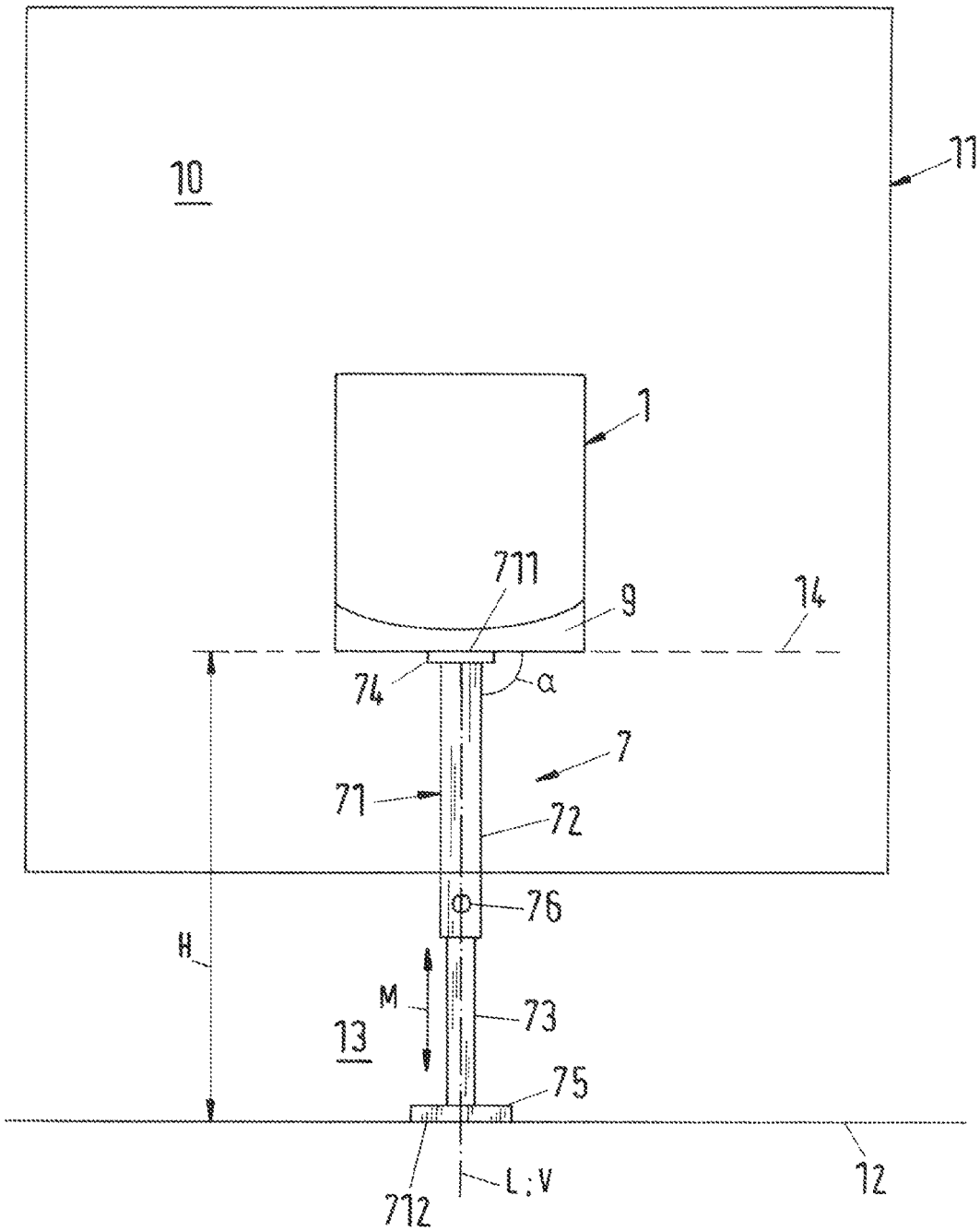
FIG. 6 is a plan view from the backside of a second embodiment of a rotary machine according to the invention, mounted to a wall of a vessel and designed as an agitator.

FIG. 6 shows a plan view from the backside of a second embodiment of a rotary machine 1 according to the invention, mounted to the wall 10 of a vessel 11 and designed as an agitator 1. In the following description only the differences to the first embodiment will be explained. In particular, the reference numerals have the same meaning as already explained in connection with the first embodiment. It shall be understood that all the explanations given hereinbefore are also valid for the second embodiment in the same manner or in an analogous manner.

In the second embodiment the support structure 7 comprises only one leg 71. The leg 71 is extending in the vertical direction V, i.e. the longitudinal axis L of the leg 71 coincides with the vertical direction V. The mounting plate 74 is arranged centrally with respect to the connecting part 9 to provide the most effective support. If the agitator 1 is horizontally mounted the mounting plate 74 extends in the horizontal plane 14. Thus, the mounting angle α between the horizontal plane 14 in which the mounting plate 74 extends and the longitudinal axis L of the leg 71 equals 90 degree.

Also for the second embodiment it is possible that the agitator 1 is designed for an oblique mounting to the wall of a vessel, i.e. the rotation axis A or the drive shaft 3, respectively, of the mounted agitator 1 includes an angle with the horizontal direction that is different from zero degree and different from 90 degree. In this case the mounting plate 74 is extending in a plane that is parallel to the rotation axis A such that there is a plane contact surface between the mounting plate 74 and the connecting part 9. Of course, the leg 71 is again extending in the vertical direction V.

The invention claimed is:

1. A rotary machine for mixing, pumping or agitating a fluid comprising:

an impeller configured to act on the fluid;

a drive unit including a drive motor and configured to rotate the impeller around a rotation axis;

a drive shaft connecting the impeller with the drive unit;

a mounting flange configured to fasten the rotary machine to a wall of a vessel;

a housing part disposed around the drive shaft and including a connecting part, the connecting part having a first side connected to the housing part and a second side, the second side being opposite the first side and being substantially planar, and the drive motor radially offset and detachably connected to the housing part; and a support structure configured to support the rotary machine, the support structure comprising at least one leg, each of the at least one leg extending in a vertical plane from a first end along a longitudinal axis to a second end, each of the at least one leg comprising an outer member and an inner member coaxially arranged in the outer member, the inner member slidingly movable relative to the outer member for adjusting the length of the respective leg, each of the at least one leg comprising a mounting plate at the first end of a respective leg, the mounting plate being substantially planar and configured to detachably mount to the second side of the connecting part of the housing part to fixedly mount the respective leg to the housing part of the rotary machine.

2. The rotary machine in accordance with claim 1, wherein a base plate at the second end of the respective leg is configured to connect the leg to a foundation or the ground.

3. The rotary machine in accordance with claim 1, wherein the outer member comprises at least one pre-drilled hole configured to receive a securing element.

4. The rotary machine in accordance with claim 2, wherein a plane in which the mounting plate extends and the longitudinal axis of the leg include a mounting angle that is different from 90 degrees for each leg.

5. The rotary machine in accordance with claim 4, wherein the at least one leg includes two legs, and the mounting angle for each leg is between 60° and 85°.

6. The rotary machine in accordance with claim 1, wherein the outer member and the inner member have rectangular cross sections in a section perpendicular to the longitudinal axis of the at least one leg.

7. The rotary machine in accordance with claim 6, wherein the outer member has four side faces and two different and abutting side faces each include at least one pre-drilled hole.

8. The rotary machine in accordance with claim 6, wherein the outer member and the inner member have square cross sections.

9. The rotary machine in accordance with claim 5, wherein the mounting angle for each leg is between 70° and 80°.

10. The rotary machine in accordance with claim 1 wherein the mounting plate is mountable to the connecting part by screws.

11. The rotary machine in accordance with claim 1, wherein the rotary machine is an agitator configured to mix or agitate a fluid.

12. The rotary machine in accordance with claim 11, wherein the agitator is configured to be horizontally mounted to a wall of a vessel.

13. The rotary machine in accordance with claim 1, wherein the first side of the connecting part includes a first side part and a second side part, the first side part abuts the housing part and has a contour that matches an outer contour of the housing part, and the second side part extends tangentially from the outer contour of the housing part.

14. A method of mounting a rotary machine for mixing, pumping or agitating a fluid to a wall of a vessel comprising:

fastening a mounting flange of the rotary machine to the wall of the vessel;

fixedly mounting at least one leg of a support structure to a connecting part of a housing part of the rotary machine with a mounting plate, the connecting part having a first side connected to the housing part and a second side, the second side being opposite the first side and being substantially planar, the mounting plate being substantially planar and capable of being detached from the second side of the connecting part of the housing part, and including extending the at least one leg by moving an inner member of the at least one leg relative to a coaxially arranged outer member of the at least one leg along a longitudinal axis of the at least one leg until a base plate of the leg contacts a foundation, and fixing the inner member to the outer member of the at least one leg; and detachably connecting a drive motor to the radial side of the housing part.

15. The method in accordance with claim 14, wherein fixing the inner member to the outer member of the at least one leg comprises selecting one of a plurality of pre-drilled holes in the outer member, using the selected hole for generating a perforation extending through an entirety of the at least one leg, inserting a securing element into the perforation for fixing the inner member to the outer member.

16. The method in accordance with claim 14 wherein the at least one leg includes exactly two legs for supporting the rotary machine.

17. The method in accordance with claim 14 wherein the rotary machine is an agitator that is horizontally mounted.

18. The method in accordance with claim 14, wherein the first side of the connecting part includes a first side part and a second side part, the first side part abuts the housing part and has a contour that matches an outer contour of the housing part, and the second side part extends tangentially from the outer contour of the housing part.

* * * * *